United States Patent [19]

Decker, Jr. et al.

[11] Patent Number: 4,969,381

[45] Date of Patent: Nov. 13, 1990

[54] COMPOSITE-MATERIALS ACOUSTIC STRINGED MUSICAL INSTRUMENT

[75] Inventors: John A. Decker, Jr.; Linda M. Decker, both of Wailuku; Christopher J. Halford, Makawao, all of Hi.

[73] Assignee: Kuau Technology, Ltd., Maui, Hi.

[21] Appl. No.: 393,695

[22] Filed: Aug. 11, 1989

Related U.S. Application Data

[62] Division of Ser. No. 80,312, Jul. 31, 1987.

[51] Int. Cl.[5] ..... G10D 1/08

[52] U.S. Cl. ..... 84/291; 84/193; 84/275; 84/452 P

[58] Field of Search ..... 84/193, 275, 291, 452

[56] References Cited

U.S. PATENT DOCUMENTS

| | | | |
|---|---|---|---|
| 3,427,915 | 2/1969 | Mooney | 84/275 |
| 3,699,836 | 10/1972 | Glasser | 84/291 |
| 4,064,780 | 11/1977 | Bond | 84/314 |
| 4,128,695 | 11/1978 | Kikuchi | 428/423 |
| 4,145,948 | 3/1979 | Turner | 84/293 |
| 4,185,534 | 1/1980 | Cove | 84/291 |
| 4,188,850 | 2/1980 | Kaman, II | 84/291 |
| 4,213,370 | 7/1980 | Jones | 84/291 |
| 4,260,095 | 4/1981 | Smith | 228/130 |
| 4,290,336 | 9/1981 | Peavey | 84/291 |
| 4,334,452 | 6/1982 | Morrison, III et al. | 84/1.16 |
| 4,353,862 | 10/1982 | Kaman, II | 264/571 |
| 4,408,516 | 10/1983 | John | 84/275 |
| 4,510,837 | 4/1985 | Keller | 84/184 |

FOREIGN PATENT DOCUMENTS 59-90205 5/1984 Japan .

OTHER PUBLICATIONS

L. H. Miner, "Fibrous Reinforcements", Modern Plastics Encyclopedia, pp. 132, 138 and 140 (1986–1987).
Dow Corning, "Silicone Moldmaking Materials from Dow Corning", pp. 1–11 (published before Jul. 1986).
Hexcel, "Advanced Composite Fabrics", pp. 1–10.
Orcon Corporation, "Performance with Strength—Orcoweb", (1982).
Haines et al., "Application of Graphics Composites in Musical Instruments", ASME Design Conference, pp. 13–15 (1975).
Gruhn et al., "Innovation and Artistry Maria Maccferri", Guitar Player, pp. 48, 82 (Feb. 1986).
Product Sheet "Graphite—Epoxy Composites", p. 79.

*Primary Examiner*—Lawrence R. Franklin
*Attorney, Agent, or Firm*—Fish & Richardson

[57] ABSTRACT

A soundboard for an acoustic guitar is made of a composite-materials plate having an area density matching that of wooden soundboards while having a bulk density exceeding the bulk density of wooden soundboards. The soundboard is preferably made of a lay-up of woven polymer (preferably aramid) fabric and a layer of unidirectional graphite fibers followed by a layer of decorative fabric (e.g., silk), all embedded in a resin matrix. The side and back are made of at least one layer of woven fabric embedded in a resin matrix. The neck is made of a foam plastic core preferably covered with a woven fabric layer and a decorative fabric layer embedded in a resin matrix. The head is preferably cast of fiber-filled thermoplastic covered with a fabric layer embedded in a resin matrix. The head and neck are channelled to receive a composite-materials reinforcing rod, a fret board of similar material being bonded thereto.

10 Claims, 5 Drawing Sheets

COMPOSITE-MATERIALS ACOUSTIC STRINGED MUSICAL INSTRUMENT

This is a division of application Ser. No. 080,312, filed July 31, 1987.

BACKGROUND OF THE INVENTION

The invention relates to methods of construction and materials for acoustic stringed musical instruments.

Acoustic stringed instruments, such as traditional acoustic guitars, are made almost entirely of wood. Fine-grained soft woods, principally spruce, red cedar and redwood, are used for soundboard construction in high quality classical guitars, with the sides and back often made of rosewood. Grand concert instruments with exquisite tonal qualities can be produced by traditional methods. However, wooden instruments are inherently vulnerable to the elements, particularly humidity, moisture and heat. There have been many attempts in recent years to make guitars and other acoustic stringed instruments out of synthetic materials which are intended to perform acoustically in the same manner as wood. Some of these attempts focus on low cost substitutes for wood to eliminate the painstaking craftsmanship required for constructing fine guitars. The focus of the present application is on high performance materials and techniques which mimic as closely as possible the acoustic properties of the various materials and techniques used in fine classical guitars while producing an instrument which is impervious to weather. The same principles are applicable to construction of other acoustic stringed instruments including, for example, the violin family.

SUMMARY OF THE INVENTION

A general feature of the invention is a soundboard for an acoustic stringed instrument made from a composite-materials plate having an area density matching that of wooden soundboards while having a bulk density exceeding (typically at least five times as great as) the bulk density of wooden soundboards. Preferably, for classical guitars, the area density of the composite-materials soundboard is about 0.15 to 0.30 grams per square centimeter (g/sq. cm) and the bulk density is about 1 to 2 grams per cubic centimeter (g/cc). The preferred plate is about 1 to 2 millimeters (mm) thick.

Another aspect of the invention is a composite-materials soundboard for an acoustic stringed instrument made of a lay up incorporating a layer of woven polymer (preferably aramid) fabric for acoustic damping. The lay-up preferably also incorporates a layer of substantially unidirectional graphite fibers running parallel to the strings embedded in a resin matrix.

Another general feature of the invention is to make a composite-materials soundboard from a multiple ply lay-up incorporating an upper layer of decorative fabric, preferably silk, embedded in the resin matrix. When used over the graphite layer, a background layer of white fabric (preferably cotton) is ideally inserted therebetween.

Another general feature of the invention is a method of constructing a composite materials soundboard for an acoustic guitar, namely, applying to a mold a base layer of unidirectional graphite fibers running the length of the soundboard, overlaying a layer of acoustically dumping woven fabric, impregnating the layers with resin and removing the excess material after curing the resin to form the soundboard.

Another general feature of the invention is employing the soundboard of the foregoing description in making up a stringed instrument body composed of back and side members, each having at least one layer of woven fabric and preferably also a layer of decorative fabric embedded in a resin matrix.

A further feature of the invention is employing the body of the foregoing description to make an all composite materials acoustic stringed instrument, for example, a guitar, including a neck with a rigid foam plastic core, preferably channelled to receive a composite materials reinforcing rod. Preferably the core is covered with at least one layer of woven fabric and a top layer of decorative fabric embedded in a resin matrix. The neck is preferably assembled to a head made of cast fiber filled thermoplastic incorporating a reinforcing rod joined to the reinforcing rod in the neck and embedded in the casting for the head. Preferably the head is covered with a woven fabric topped with a decorative fabric embedded in a resin matrix.

DESCRIPTION OF THE PREFERRED EMBODIMENT

The drawings are briefly described as follows.

Figure 4:
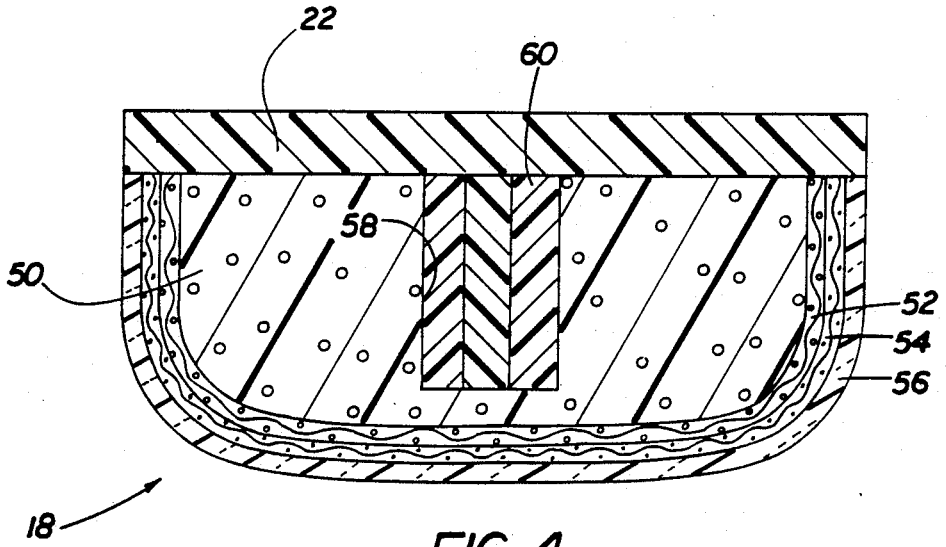
FIG. 4 is a cross-sectional view of the neck taken along lines 4—4 of FIG. 1.
Figure 7:
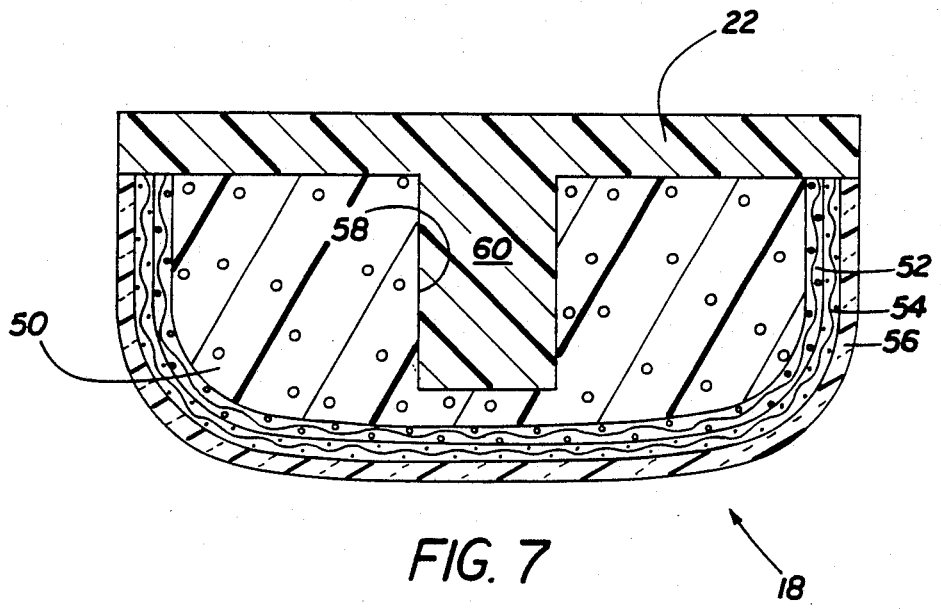

FIG. 7, like FIG. 4, is a cross-sectional view of the neck, alternate embodiment with an integral fret board and reinforcing rod.

STRUCTURE

The invention is applicable to stringed instruments generally, the following description of classical guitar construction being just one example. The term "wooden soundboard", as used herein, refers to a traditional stringed instrument soundboard made entirely of fine-grained soft wood such as spruce, red cedar or redwood. The term "composite-materials" means any component made chiefly of two or more weather-resistant nonwooden materials, for example, resin/fabric lay ups, as described herein.

Figure 1:
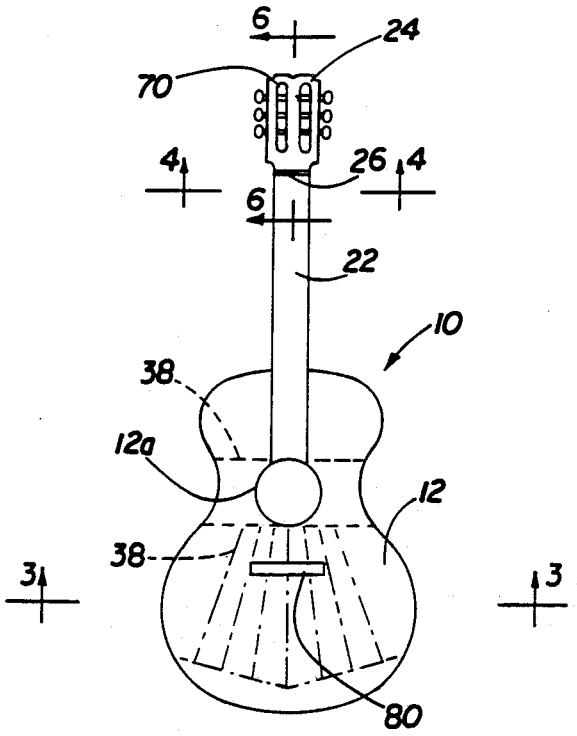
FIG. 1 is a front view of a composite-materials classical guitar.
Figure 2:
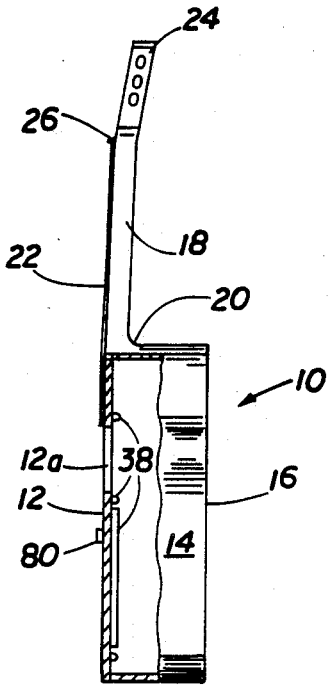
FIG. 2 is a side view of the guitar of FIG. 1.

FIGS. 1 and 2 show a guitar of classical configuration including a sound box or body 10 composed of a soundboard 12, a continuous curved side 14 and a back 16, roughly parallel to the soundboard 12. Actually, the outer surfaces of the soundboard and back are often slightly convex. A neck 18 is anchored at the heel 20 to the top of the side 14 and a fret board 22 extends down the length of the face of the neck and over the surface of the soundboard 12 up to the sound hole 12*a*. At its upper extremity, the neck is attached to a headstock or head 24 which carries the tuners or tuning machines including keys and spindles on which the ends of the strings (not shown) are wound and stretched over the nut 26 at the top of the fret board 22.

Apart from the strings, the most important element of the classical guitar in determining the overall tone quality is the soundboard itself. Prior attempts at construction from composite materials have tried to match the bulk or volume density of wooden soundboards, typically about 0.5 grams per cubic centimeter (g/cc). As the bulk density of composite materials is normally in a range of 1 to 2 g/cc, bulk density matching requires the incorporation of low density core materials. This solution is not ideal from either a manufacturing or an acoustical standpoint.

As it turns out, the predominant terms in the equations describing the acoustic properties of the typical wooden soundboard are related to two-dimensional modes of vibration in the plane of the soundboard. Depth modes of vibration perpendicular to the plane of the soundboard are of much lesser significance. The observation that the perpendicular terms are influenced primarily by the volume or bulk density of the material and the in-plane terms are influenced primarily by the area density of the material (mass per unit area in terms of grams per square centimeter (g/sq. cm)) suggests that area density is the key to determining tonal quality. It is, therefore, proposed to make a "two-dimensional" match to the traditional wooden soundboard by matching the area density of the wooden soundboard. Typical spruce soundboards, for example, have area densities of the order of 0.15 g/sq. cm. A similar area density can be achieved with heavier composite materials in a thinner soundboard. In particular, this area density can be matched with a one or two layer lay up of fibers in a resin matrix as described hereinbelow.

A separate problem addressed by the present invention is the tinny sound emitted by soundboards made entirely of graphite/epoxy or other graphite/resin systems due to their excessively high acoustic transmissivity. Compared to wood these materials have too little acoustic loss. In order to more closely match the acoustic properties of traditional wooden soundboards, a layer of acoustically dead fabric such as Kevlar® or Dacron® can be incorporated into a graphite/resin lay up as will now be described in detail.

Figure 3:
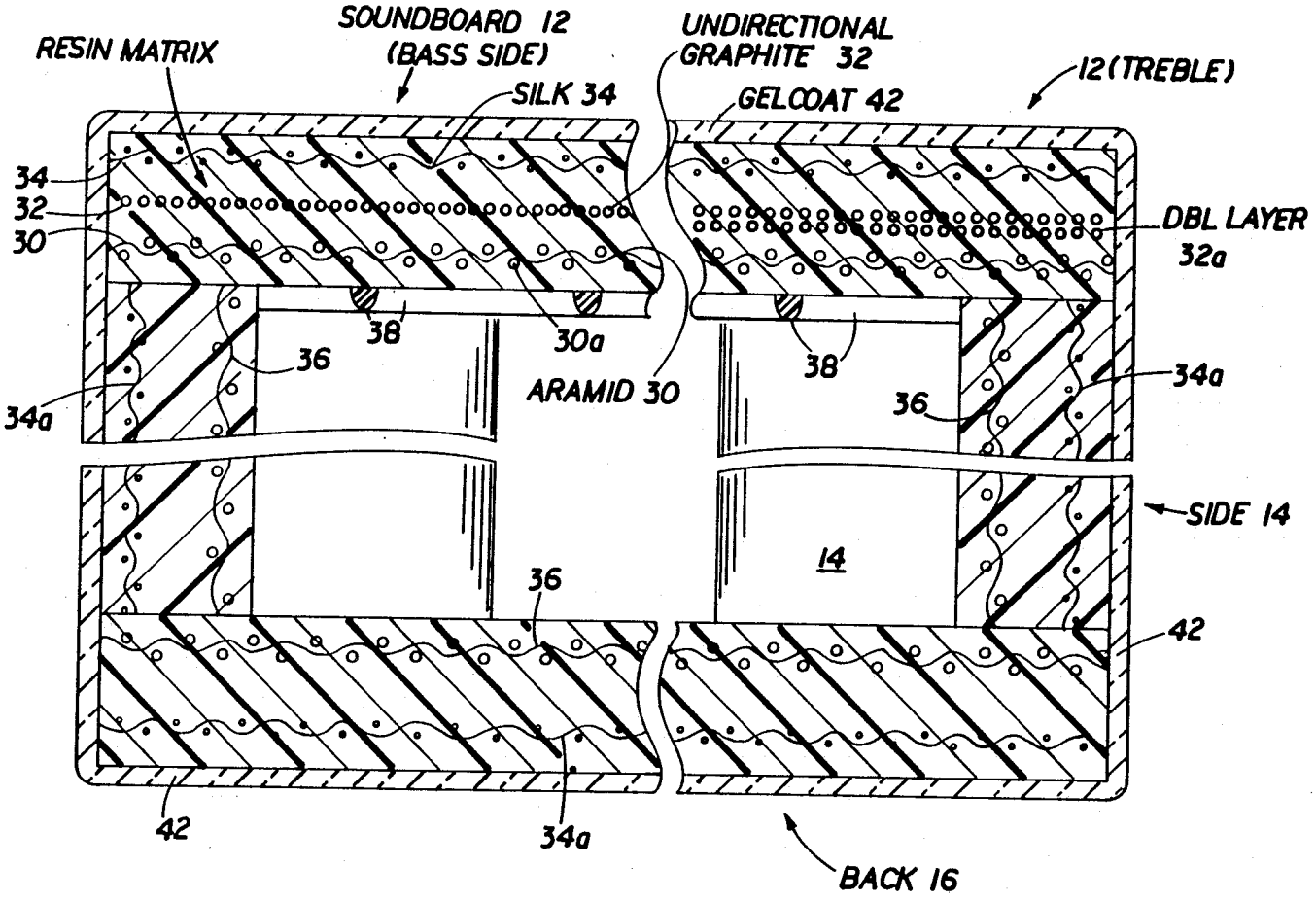
FIG. 3 is a cross-sectional view of the guitar body with portion broken away taken along lines 3—3 of FIG. 1.

As shown in FIG. 3, the soundboard 12, side 14 and back 16 of the composite guitar, are each composed of a lay up specifically designed for the role played by the corresponding part. The soundboard represents the most serious technical challenge in achieving a successful composite materials acoustic guitar as it is the primary determinant of the guitar's sound quality and has strict technical requirements in terms of tensile strength, stiffness and density.

Soundboard

As shown in FIG. 3, the soundboard 12 of the present invention consists (from bottom to top) of a resin lay-up of woven polymer fabric 30, preferably a cross-weave of polymer yarn or threads 30*a* each composed of continuous multiple filaments followed by a layer of juxtaposed unidirectional fibers 32, preferably graphite running the length of the soundboard, like wood grain, in the same direction as the neck, followed by a thin cloth layer of decorative fabric 34, preferably silk. The graphite layer 32 is preferably doubled on the treble half of the soundboard as shown in FIG. 3, when traditional fan bracing patterns are used on the underside of the soundboard. Alternatively, the graphite layer 32 can be uniform across its width while employing the relatively new Kasha-design bracing system for the classical guitar soundboard.

The preferred fabric 30 is made of aramid fibers of the type sold under the trademark Kevlar® by E. I. DuPont deNemours & Co. Inc. Preferred fabrics are available commercially from Hexcel Corporation as No. 500 (a 13×13 plain weave), No. 205 (a 17×17 crowfoot weave) and No. 281 (a 17×17 plain weave). These Hexcel fabrics have a weight of about 5 ounces per yard (oz./yd.). A similar but heavier fabric is available from Orcon Corp. of Union City, Calif. as Orcon KS400 with an S-glass cross weave at about 6.3 oz./yd.

The preferred graphite ply is one commercially available from Orcon as Orcoweb® G-450 or G-900 (the difference being mesh size). Orcoweb has parallel continuous coplanar monofilaments of carbon cross-linked about every inch and a half by an adhesively bonded Nomex® aramid fiber. An alternate graphite material, although less preferred, is Hexcel cross-woven graphite and S-glass, F3C211 (a 10.5×10.5 plain weave) and F3T282 (a 12.5×12.5 plainweave).

Epoxy, polyester or vinylester resins may be used in the lay up. Vinylester resin is currently preferred due to its post-cure dimensional stability and better tone quality. One serviceable vinylester product is Aplac 580-05 from Koppers Chemical Co. of Pittsburgh, Pa. used in conjunction with the common hardener methyl ethyl ketone peroxide (MEKP)Epoxy resin would be the second choice due to better dimensional stability than polyester.

The soundboard is actually laid up in a manner similar to surfboard and sailboat construction by applying the fabric layers in sequence (top down first) over a fiberglass mold (typically a female (concave) mold (not shown) incorporating any desired slight curvature) and bonding the layers together with the resin. Well known liquid resin/squeegee hand techniques can be used, as can preimpregnated fabrics. In practice, it has been found preferable to make the lay-up resin poor by pressing as much of the resin out of the lay-up as possible during each step.

A soundboard made in accordance with the foregoing specifications has a thickness of 1 to 2 mm (typically 1.5 mm) and an area density of 0.15 to 0.30 g/sq.cm. matching the area density of the classical wooden soundboard. The bulk density is about 2 to 4 times that of wooden soundboards (typically 1 to 2 g/cc).

The method of manufacturing the soundboard begins with coating the surface of the female mold with a conventional release agent, and applying a full width decorative silk cloth 34. Vinylester resin is then poured over the cloth and squeegeed into the fabric removing excess resin at the same time. Next, the unidirectional graphite layer 32 is applied and impregnated with resin in the same manner, followed by the layer 30 of woven aramid which again is impregnated with resin in the same manner. The lay-up process is complete at this point and the composite material is allowed to cure.

With classical wooden soundboards, braces glued to the inside of the soundboard have long been used to enhance tone quality. Several schools of thought have developed in support of different bracing patterns, among them the symmetrical Torres fan bracing pattern and the assymetrical Kasha design. Previous attempts at constructing composite-materials acoustic guitars have invariably abandoned the prior bracing patterns for wooden soundboards in favor of analytically derived patterns. In contrast, the construction technique of the present application embraces and utilizes the basic design and hand construction of traditional classical guitar making. Thus, a standard or modified bracing pattern for wooden classical guitars is used in the present composite-materials soundboard. Braces 38 are glued to the inside of the soundboard 12 according to the same locating principles as used in a wooden classical guitar. A modified fan bracing pattern is preferred, like that used by Lorenzo Pimentel & Sons of Albuquerque, N. Mex.

The braces are of conventional cross-section and shape, but are preferably made of vacuum-pressed graphite/epoxy. This material is produced under pressure and has an extremely high density of fibers, mostly unidirectional. The material has the feel of black balsa wood and is available in strips $\frac{3}{8}''$ to $\frac{1}{2}''$ wide by $\frac{1}{8}''$ to $\frac{1}{4}''$ thick as part Nos. GR-1-4 from Luthiers Mercantile, Healdsburg, Calif.

Because the graphite epoxy material has increased stiffness and strength, the braces may be somewhat smaller and lighter than wooden (e.g., spruce) braces. The strips are glued to the underside of the soundboard using AMR or similar epoxy resins.

Back and Sides

Graphite-fiber composites are used in the back and sides of the guitar to provide the needed strength and stiffness while maintaining the low weight of a fine wooden guitar.

The fabric lay-up technique for the back and sides uses one woven graphite/S-glass crossweave layer 36 (e.g., Hexcel F3C211) or two all graphite crossweave layers, followed by a decorative fabric (preferably silk) outer layer 34*a*. The layers are laid up with vinylester resin inside molds incorporating the shape and curvature of the guitar body. Two molds are used: a female mold for the back and a separate female mold for the figure 8 sides to avoid lamination problems at the back/-side corner. As with the soundboard, vacuum-pressed graphite/epoxy is used for the back braces which are similar in form and location to traditional wood back bracing and are bonded to the back using AMR or other epoxy resin. The back 16 can be made of a lay up of fiberglass/graphite cross-weave in which the graphite runs in the same direction as the unidirectional graphite in the soundboard. Similar materials can be used for the side 14.

If desired, the top and bottom of the side member may receive extra laminations for increased strength.

Shaping and Assembly

The soundboard 12, side 14, and back 16 are cut to shape by a bandsaw and finished by means of a power sander or similar tools. The sound hole 12*a* is cut in the soundboard 12 in a similar manner with a hole saw or similar tool and finished with a sander. Carbide (or better) cutting tools are desirable because of the abrasiveness of the carbon and aramid fibers.

After the materials are cut to shape, the soundboard 12, side 14 and back 16 are assembled and epoxied together with corner braces (small pieces of Orcoweb graphite cloth soaked in resin), as in wooden guitars, to complete the body 10 of the guitar. Next, a thin transparent coating of gel coat 42 is sprayed over all of the outside surfaces of the body 10. The final top layer of gel coat provides a transparent base for polishing. The polishing process is conventional and essentially identical to that used for surfboards. If desired, the gel coat may await the attachment of the neck and headstock except that the fret board 22 is desirably left uncoated.

Neck and Headstock

The neck 18 and fret board 22 assembly serves two essential functions: (1) to resist the bending forces applied by the string tension and (2) to provide a rigid surface for the fingering action. Traditional classical guitars use hardwoods such as Spanish cedar or mahogany for the neck while steel string acoustic guitars and electric guitars use steel reinforced hardwood or, recently, graphite/epoxy composites. Fret boards are almost universally a very hard hardwood, ebony and rosewood being the most popular.

Figure 5:
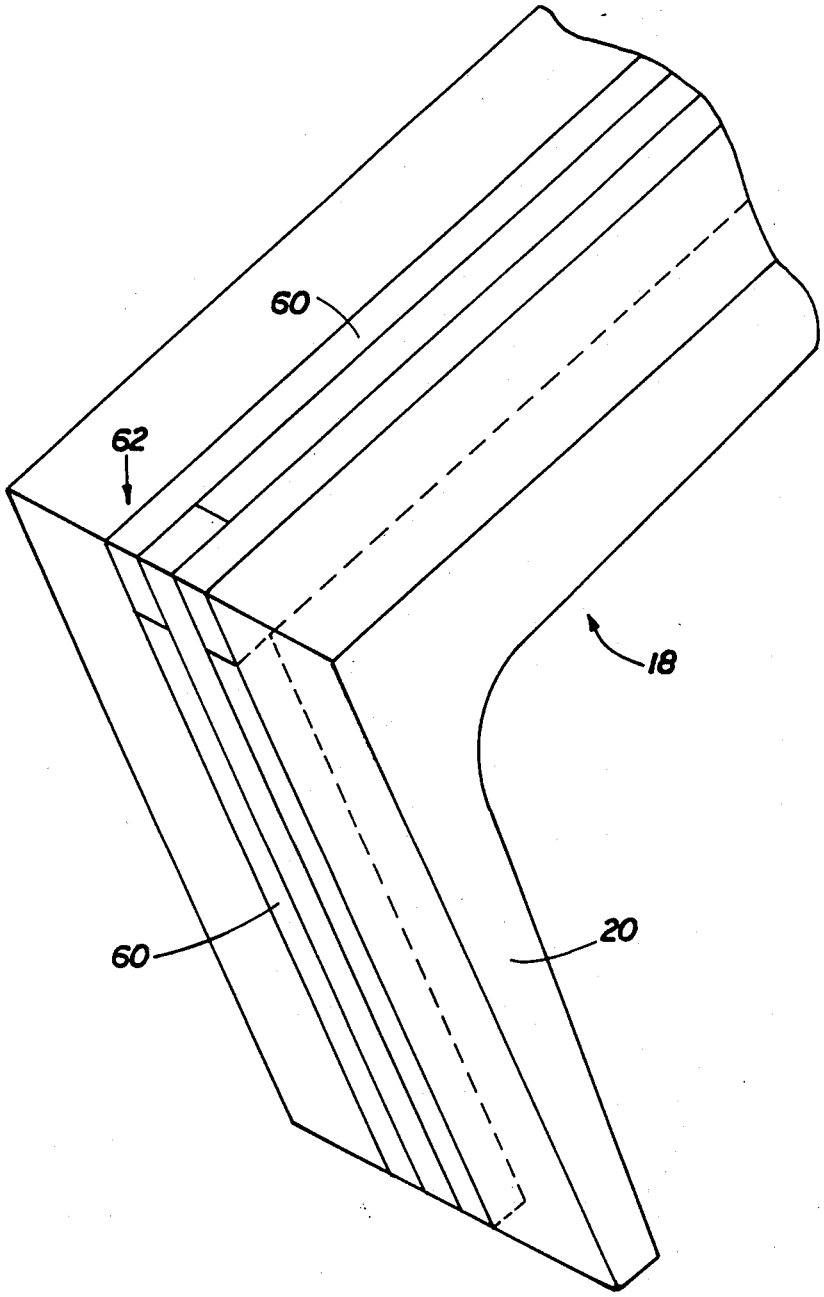
FIG. 5 is a simplified oblique isometric detail view of the heel portion of the neck of the guitar of FIGS. 1 and 2 without the fret board to reveal the reinforcing rod.
Figure 6:
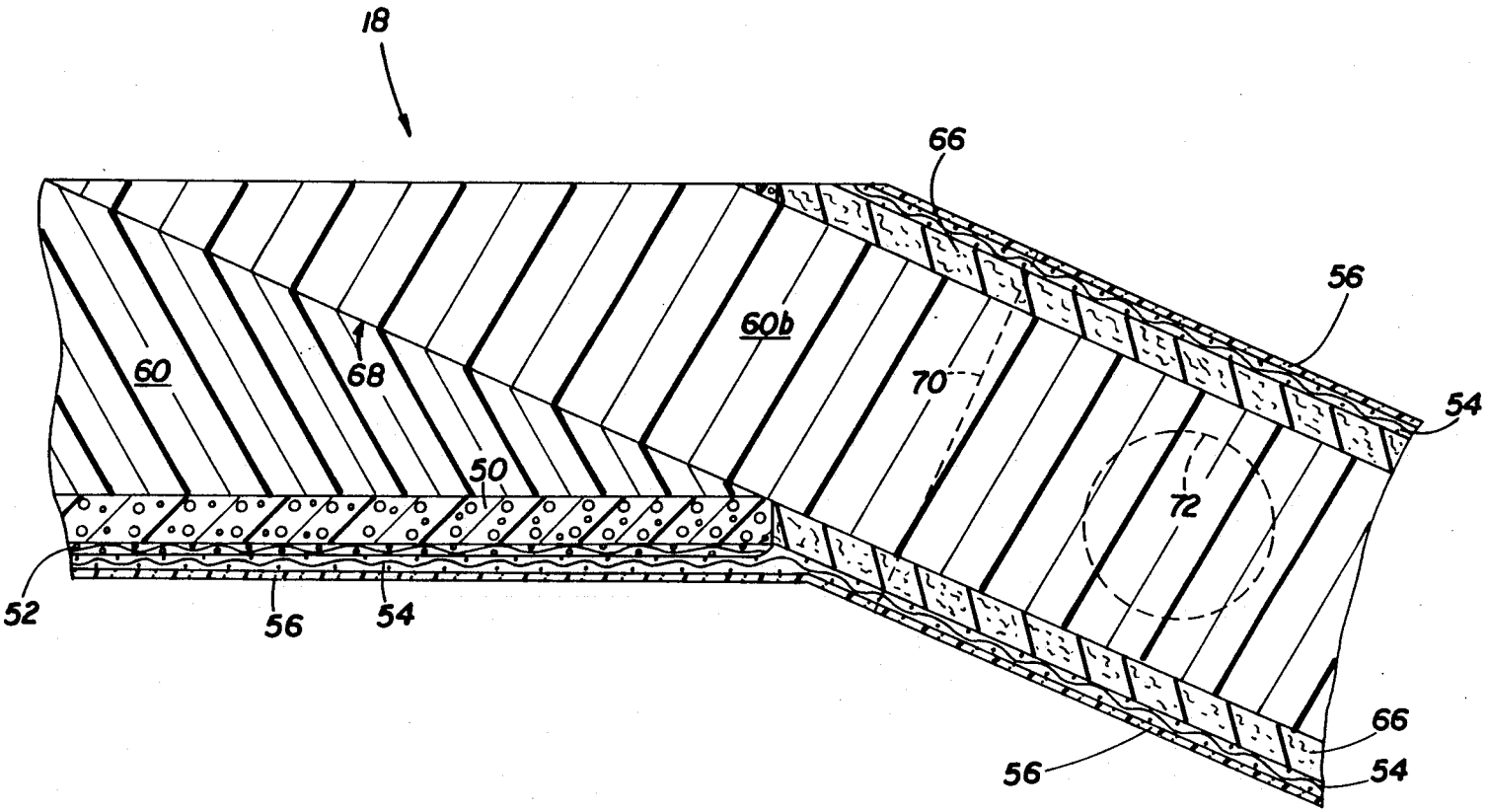
FIG. 6 is a central longitudinal sectional detail view of the head/neck joint taken along lines 6—6 of FIG. 1.

The neck construction shown in FIGS. 4 and 5 departs from conventional techniques in several respects. First, the neck and fret board are treated as a single structural element. As shown in FIG. 4, the neck 18 has a foam core 50 of high density polyester. The curved outer surface of the core 50 is covered with one or more layers (shown in FIG. 4) of woven graphite cloth 52 or a graphite/S-glass crossweave in an epoxy or vinylester resin matrix for added strength and resistance to finger pressure, followed by a decorative fabric surface layer, preferably silk, 54 and the final gel coat layer 56. The foam core 50 is routed or cast with a central channel 58 running the length of the face of the neck. The channel 58 receives a multi-layer laminate reinforcing rod 60 made of two or three pieces of vacuum pressed graphite/epoxy of the same composition as that used for the soundboard braces. Alternately the fret board can be formed of cast polyester and chopped graphite fibers and reinforcing rods. Reinforcing rod 60 runs axially along the neck and continues at both ends into the heel 20 and head 24 shown in FIGS. 5 and 6, respectively. As shown in FIG. 5, a lapped, tongue and groove joint 62 may be advantageously employed with a multi-piece laminate as shown to turn the 90° corner where the neck meets the body of the guitar 10 at heel 20. Heel 20 and neck 18 are preferably injection molded or cast from a single integral foam core 50.

At the top, the neck joins the head 24 as shown in FIGS. 1, 2 and 7. Head 24 is cast for strength and lightness to keep the instrument balanced. Quarter-inch chopped graphite fibers in a cast polyester matrix 66 form the base of the head 24. A suitable polyester is Evercoat 521 casting resin from Fiberglass Evercoat Co. of Orange, Calif. available from Fiberglass Hawaii in Hi. Graphite/epoxy neck reinforcing rod 60 in the neck is connected with an angular lapped joint 68, similar to joint 62 at the head, to a similar reinforcement rod segment 60*b* extending at an angle to the neck through the center of the head 24 as shown. Reinforcing rod 60*b* is assembled in the mold before the filled polyester 66 is cast so that the rod 60*b* becomes embedded in the center of the head. Small sections of graphite/epoxy rods can be included in the mix before casting for additional reinforcement if necessary. The tuning machine clearance 70 and spindle holes 72 are cast-in so that the head only requires minimal finishing prior to tuning machine installation. The silk fabric layer 54 and gel coat 56 are extended over the head as well as the neck as shown.

FIG. 7 shows an alternate construction of the neck 18 similar to that of FIG. 4 except that the reinforcing rod 60 and fingerboard 22 are made of one integral extrusion of vacuum-pressed graphite/epoxy.

The neck 18 is bonded to the body 10 at the top of the side 14 as shown in FIG. 2 using AMR or a similar epoxy resin and jigs and locating pins as appropriate to assure proper alignment. The fingerboard 22, complete with frets is then bonded in place using epoxy resin, again insuring proper alignment according to traditional techniques. The fret board is made of a long strip of vacuum-pressed graphite/epoxy and, after the fret grooves are cut, is bonded in contact with the top of the reinforcing rod 60. The frets are machined by a milling machine or gang saw and require carbide or diamond tooling. Alternatively, the fret board can be cast, with the grooves in place, out of chopped graphite in polyester casting resin.

Other Parts

The bridge 80 for the composite-materials acoustic guitar can be in the traditional form—classical or steel string—but is preferably made of a casting of chopped graphite fibers in polyester resin, with a reinforcement of vacuum pressed graphite/epoxy, the same materials as the head 24. A traditional bone or ivory saddle can be bonded to the soundboard 12 using AMR epoxy resin or equivalent. Classical bridges could have embroidered silk tie bar decoration.

The cast parts such as the filled polyester core 66 of head 24, bridge 80 and fret board, if desired, are molded in Dow Corning Silastic E mold rubber, for example.

Strings, frets, nuts, tuning machines and similar hardware are already sufficiently impervious to weather in their traditional forms. Although the gears of tuning machines require a periodic lubrication to function well in humid conditions and strings require frequent wiping to prolong their useful life, no design changes are needed in these areas. Traditional ivory or bone nuts serve well, as do traditional German silver (copper/-nickel) fret wires.

Decoration

The incorporation of a decorative fabric layer is considered an important feature of the present application and lends the composite-materials guitar a distinctive esthetic appearance. While in principle, any decorative fabric desired by a customer could be used, in practice fabrics are chosen to closely match the color, rain and visual quality of the woods used in a traditional acoustic guitar. For instance, a pale reddish-yellow raw silk might be used to simulate the red cedar soundboard of a traditional classical guitar, while a dark reddish brown natural silk with pronounced black roughness might be used to simulate its rosewood back and sides. At a distance, such a guitar would appear to be a cedar/rosewood instrument. On closer inspection, however, the pattern would be apparent as fabric texture, not wood grain. In keeping with its fine tone quality, the composite-materials acoustic guitar should strike the eye as well as the ear as a fine guitar and not look like a mere imitation of a wood guitar.

The silk or other decorative fabric also serves as a veil layer to cover the graphite fiber and aramid layers for polishing. Thin silk layers have little or no effect on the audible acoustic quality of the guitar. Thus, the thinnest tie silk is ideal. Thicker silks, however, if used in the soundboard, will require adjustment of the amount of acoustically damping fabric (preferably aramid) to maintain the desired soundboard damping. This is not a problem for the back, sides, neck or head surfaces since the overall acoustics are not sensitive to small additional acoustic losses in these secondary elements.

In keeping with the predominantly fabric nature of the composite-materials acoustic guitar, the soundboard rosette may be made of fabric and/or embroidery embedded in the resin matrix, instead of the traditional wood marquetry inlay. The center of the face of the head 24 between the clearance holes 70 can incorporate an embroidery pattern 74 traditionally related to the patterns for the rosette and tie bar, to mimic the decorative inlay of fine classical wood guitars, if desired.

General construction proceeds in a fairly traditional manner as described above. After making the various components of the guitar, they are assembled together using epoxy resin bonding with alignment jigs and pins. The completed structure, except for the fret board, is given a coat or two of transparent gel coat by means of conventional spraying techniques and the instrument is then polished using time honored abrasives, buffers, etc. Stringing up, testing, action adjustment (by raising or lowering the nut and/or saddle) and tuning all proceed according to traditional techniques. If desired, the fret board may receive a coat of shellac.

The foregoing description of the preferred embodiment is intended for purposes of illustration of the general principles of construction of the composite-materials acoustic guitar. Not all of the components described herein have to be used together. Certain components can be modified or used in combination with various components made conventionally or with composite materials different from those disclosed herein. While graphite and aramid fibers are favored materials at present, other materials having similar properties may be substituted. For example, polyester fiber fabric (Dacron®) may be tried in place of the aramid fabric, but aramid is believed to function better for acoustic damping and strengthening.

Other embodiments are within the claims. The specific implementation for an acoustic classical guitar given here is only by way of illustration. The principles are applicable to other stringed instruments besides classical guitars, for example, the violin family.

We claim:

1. A composite-materials soundboard for an acoustic stringed instrument, comprising a resin matrix lay-up incorporating cross-woven threads each made up of multiple continuous polymer filaments of an acoustically damping material and substantially coplanar fibers extending substantially parallel to the strings of the instrument, said fibers being made of a material providing low acoustic dampening compared to said filaments.

2. The soundboard of claim 1, wherein said filaments are made of aramid fiber.

3. The soundboard of claim 2, wherein said fibers are made of graphite.

4. The soundboard of claim 3, wherein said lay-up further incorporates a layer of decorative fabric on the visible exterior side.

5. The soundboard of claim 4, wherein said decorative fabric is silk.

6. The soundboard of claim 4, wherein said graphite fibers and aramid filaments are provided in separate layers behind said decorative fabric layer.

7. The soundboard of claim 6, wherein said decorative fabric is silk.

8. The soundboard of claim 7, wherein said lay-up further incorporates a layer of cotton woven fabric between the silk layer and the unidirectional graphite layer.

9. The soundboard of claim 4, wherein said decorative fabric has a uniform color selected to match the color of corresponding traditional soundboards for the same type of stringed instrument.

10. The soundboard of claim 1, wherein said graphite fibers and aramid filaments are provided in separate layers.

* * * * *

UNITED STATES PATENT AND TRADEMARK OFFICE

CERTIFICATE OF CORRECTION

PATENT NO. : 4,969,381

DATED : November, 13, 1990

INVENTOR(S) : John A. Decker, Jr., et al

It is certified that error appears in the above-identified patent and that said Letters Patent is hereby corrected as shown below:

On the title page, item [56]:

Under References Cited Insert:

4,429,608 - Kaman et al.
4,364,990 - Haines
3,880,040 - Kaman
1,602,355 - P.A.R. Frank
2,469,582 - E. Strong
3,474,697 - C.H. Kaman
4,084,476 - Rickard
4,090,427 - Kaman
4,313,362 - Lieber Col. 1, line 51, insert "-" between --lay up--;
Col. 1, line 64, insert "-" between --composite materials--;
Col. 1, line 68, "dumping" should be --damping--;
Col. 2, line 41, insert --showing an-- after "neck";
Col. 3, line 49, insert "-" between --composite materials--.

Signed and Sealed this

Fourth Day of May, 1993

*Attest:*

Michael K. Kirk

MICHAEL K. KIRK

*Attesting Officer*

*Acting Commissioner of Patents and Trademarks*